United States Patent [19]

Cliquet et al.

[11] Patent Number: 4,583,020

[45] Date of Patent: Apr. 15, 1986

[54] IONIZATION CHAMBER MAKING IT POSSIBLE TO MEASURE HIGH ENERGY GAMMA RADIATION

[75] Inventors: Francois Cliquet, Etampes; Pierre Boulay, Sceaux; Jean Duchêne, Fontenay-aux-Roses; Marc Merelli, Gif sur Yvette, all of France

[73] Assignee: Commissariat a l'Energie Atomique, Paris, France

[21] Appl. No.: 512,784

[22] Filed: Jul. 11, 1983

[30] Foreign Application Priority Data

Jul. 13, 1982 [FR] France ..... 82 12270

[51] Int. Cl.[4] ..... H01J 39/26

[52] U.S. Cl. ..... 313/93; 250/385; 250/374

[58] Field of Search ..... 313/93; 250/385, 374

[56] References Cited

U.S. PATENT DOCUMENTS

| | | | |
|---|---|---|---|
| 2,440,167 | 4/1948 | Broxon et al. | 313/93 X |
| 2,499,489 | 3/1950 | Goldstein et al. | 250/83.6 |
| 2,617,955 | 11/1952 | Mandeville et al. | 313/93 |
| 2,858,465 | 10/1958 | Ludeman | 313/93 |
| 2,875,343 | 2/1959 | Birkhoff et al. | 250/385 |
| 4,289,967 | 9/1981 | Hanson et al. | 250/385 |
| 4,379,248 | 4/1983 | Wakayama et al. | 313/93 |

FOREIGN PATENT DOCUMENTS

| | | |
|---|---|---|
| 1560320 | 11/1967 | France . |
| 2425147 | 11/1979 | France . |

*Primary Examiner*—Robert Lindsay

*Attorney, Agent, or Firm*—Pearne, Gordon, Sessions, McCoy, Granger & Tilberry

[57] ABSTRACT

Ionization chamber making it possible to measure high energy gamma radiation, wherein it comprises a tight cylindrical enclosure containing an ionizable gas, and several coaxial cylindrical electrodes, which are insulated from one another, and are positioned within the enclosure and are raised to different potentials, so as to produce an electrical field in the enclosure, whereby the innermost electrode is formed by a solid cylinder, the outermost electrode is formed by a solid tube and the intermediate electrodes are formed by a perforated tube.

11 Claims, 3 Drawing Figures

IONIZATION CHAMBER MAKING IT POSSIBLE TO MEASURE HIGH ENERGY GAMMA RADIATION

BACKGROUND OF THE INVENTION

The present invention relates to an ionization chamber making it possible to measure high energy gamma radiation. It more particularly makes it possible to measure gamma radiation with energy levels close to 6 MeV. Such gamma radiation is in particular emitted by nitrogen 16 induced, by nuclear reactions, in the water of a pressurized water reactor vessel. The measurement of this gamma radiation and consequently the nitrogen 16 quantity formed is one of the means used for obtaining information on the power of a reactor and for determining the speed and flow of the fluid circulating in the primary circuit of the reactor.

From a general standpoint, an ionization chamber comprises a tight enclosure filled with an ionizable gas, and one or more electrodes making it possible to create an electrical field within the enclosure. When nuclear radiation traverses the gas in the chamber, the latter is ionized. In the presence of the electrical field, the charges produced undergo, in the direction of the field, a pull which is superimposed on the thermal agitation. This pulling of the charges and particularly the ions formed makes it possible to induce, across the electrodes, a so-called ionization current, which is measured.

The ionization chamber representing a detector well suited to the measurement of gamma radiation can permit the measurement of the gamma radiation having a dose rate from between 1 and 100 rad/hour. Bearing in mind the environmental conditions and the fact that no human intervention is possible during the operation of the reactor, in order to carry out such gamma radiation measurements and particularly of radiation emitted by nitrogen 16, induced in the water of the vessel of a reactor, the ionization chamber must have a high sensitivity for the high energy gamma photons, a good resistance to high temperature, a good resistance to vibrations, a high pass band making it possible to measure fluctuations, considerable robustness and a long service life.

The ionization chambers at present used for such a measurement and which have a low thermal sensitivity have a low sensitivity to high energy gamma photons, which makes it necessary to use amplifiers, which are very sensitive to the temperature and to the ambient humidity.

SUMMARY OF THE INVENTION

The present invention relates to an ionization chamber for measuring high energy gamma radiation and which makes it possible to obviate the aforementioned disadvantage.

Apart from its considerable sensitivity to high energy gamma radiation and its thermal resistance, the ionization chamber according to the invention has all the aforementioned features.

More specifically, the present invention relates to an ionization chamber making it possible to measure high energy gamma radiation, wherein it comprises a tight cylindrical enclosure containing an ionizable gas, and several coaxial cylindrical electrodes, which are insulated from one another and are positioned within the enclosure and are raised to different potentials, so as to produce an electrical field in the enclosure, whereby the innermost electrode is formed by a solid cylinder, the outermost electrode is formed by a solid tube and the intermediate electrodes are formed by a perforated tube.

Preferably the ionization chamber has five electrodes.

The use of several electrodes raised to different potentials, whilst the non-extreme electrodes are perforated, makes it possible to increase the mean free range of the electrons formed in the enclosure of the chamber so that, compared with the number of incident gamma photons, the number of nuclear interactions in the said chamber, as well as the electrical current induced for each interaction are increased. The increase of the mean free range of the electrons makes it possible to obtain a considerable sensitivity for the detection of high energy gamma radiation.

According to a preferred embodiment of the chamber according to the invention, the perforated electrodes have a transparency between 30 and 40%, which makes it possible to optimize the ionization current induced in the chamber.

In an ionization chamber used for the detection of high energy photons, i.e. photons having an energy level above 1 MeV, the essential part of the nuclear interactions (Compton effect of materializing a photon, i.e. production of an electron-positon pair) and consequently the induced current is produced in the walls of the enclosure and in the electrodes. To optimize the number of interactions and consequently the current induced, the thickness of the enclosure wall, as well as the material forming said wall and the electrodes, must be chosen as a function of the energy of the gamma radiation to be measured.

According to the invention, the detection of gamma radiation having an energy level close to 6 MeV is carried out by using an enclosure, whose thickness is between 3 and 4 mm and which is preferably made from stainless steel. In the same way, the electrodes can be made from stainless steel, the intermediate electrodes being in each case formed by perforated steel sheets, which are rolled and welded together.

Moreover, in view of the fact that the ionization current induced depends on the nature and pressure of the gas, preference is given to the use of gas containing 98 to 99% by weight of xenon and having e.g. a pressure between 8.8 and 9.2 bars absolute.

According to a preferred embodiment of the chamber according to the invention, the different electrodes have clearances between them, such that the electrical field is uniform throughout the enclosure. As an electric field is formed, which has the same intensity throughout the entire enclosure, it is possible to ensure a good collection of the ions formed, as well as the optimization of the pass band of the chamber.

According to a preferred embodiment of the chamber according to the invention, one of the ends of the electrodes is fixed and the other end is kept in position by first elastic means permitting an axial displacement and by second elastic means permitting a radial displacement.

Moreover, the ionization chamber according to the invention can comprise third elastic means, which act axially and solely on the other end of the intermediate electrodes.

These various elastic means make it possible to obtain an ionization chamber, which is not sensitive to temperature and vibrations.

BRIEF DESCRIPTION OF THE DRAWINGS

The invention is described in greater detail hereinafter relative to non-limitative embodiments and the attached drawings, wherein show.

DETAILED DESCRIPTION OF THE INVENTION

Figure 1:
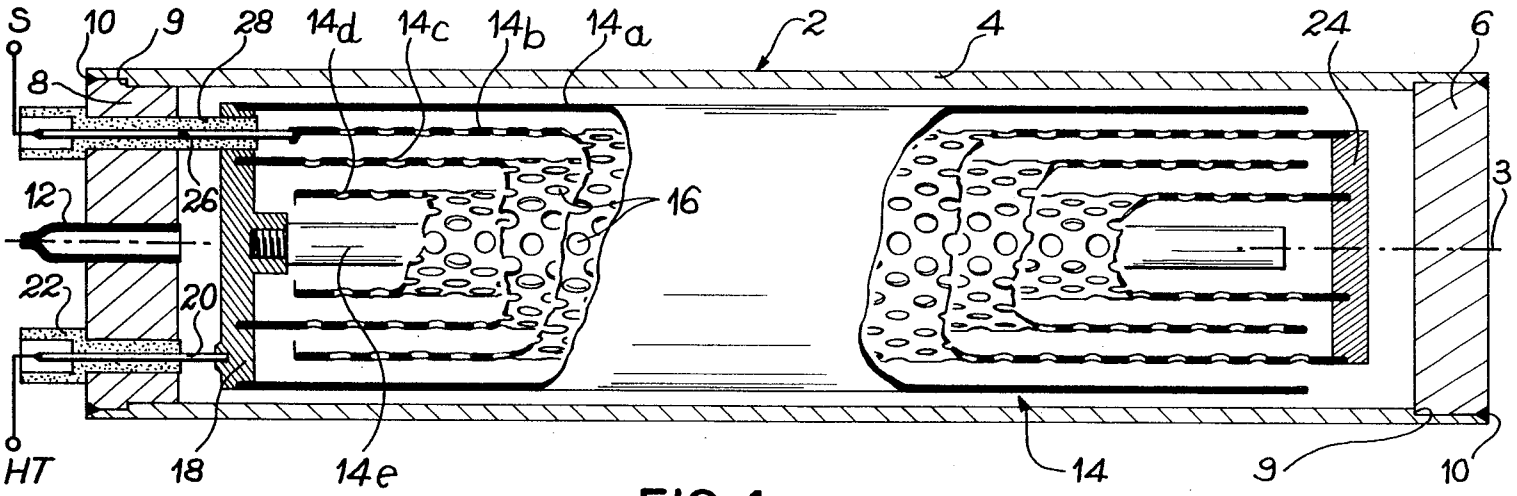
FIG. 1 a diagram of an ionization chamber according to the invention, more particularly illustrating the structure of its electrodes.

FIG. 1 is the diagram of the ionization chamber according to the invention, which comprises a tight cylindrical enclosure 2 having an axis of revolution 3 and constituted by a ferrule 4, respectively sealed at its two ends by a lower flange 6 and an upper flange 8. Flanges 6 and 8 bear on shoulders 9 of ferrule 4 and are welded to the latter by welds such as 10. Tight enclosure 2 is filled with an ionizable gas, which can be introduced into the enclosure by means of an exhaust tube 12, which is sealed after filling the enclosure.

The ionisation chamber also comprises cylindrical electrodes 14, arranged coaxially in enclosure 2 along its axis 3. There are, for example, five electrodes 14 in the manner shown in the drawing and are constituted by an outer electrode 14*a*, three intermediate electrodes 14*b*, 14*c*, and 14*d*, and a central electrode 14*e*.

The use of a large number of electrodes (e.g. 5), more particularly makes it possible to increase the useful detection volume of the ionization chamber compared with the total volume thereof, so that it is possible to increase the mean free range of the electrons in the chamber, when gamma radiation passes through the latter.

Electrodes 14*a*, 14*c* and 14*e* are electrically interconnected by means of a conducting part 18 connected, by means of a plug pin 20 traversing flange 8, to the high voltage supply. This plug pin 20 is insulated from flange 8 by means of an insulant 22, which is relatively insensitive to temperature variations, such as steatite.

In the same way, electrodes 14*b* and 14*d* are electrically interconnected by means of a conducting part 24 and are connected to output S by means of a plug pin 26 traversing part 18 and then flange 8. Pin 26 is insulated from part 18 and flange 8 by means of an insulant 28, which is relatively insensitive to temperature variations, such as steatite. Electrodes 14*b* and 14*d* are used for collecting the ions formed in the enclosure, when gamma radiation passes through the ionization chamber.

According to the invention, outer electrode 14*a* is formed by a solid tube, intermediate electrodes 14*b*, 14*c*, 14*d* by a tube having perforations 16 and central electrode 14*e* by a solid cylinder. The use of intermediate perforated electrodes makes it possible to increase the mean free range of the electrons formed in the chamber, when gamma radiation passes through the latter, so that it is consequently possible to increase the number of nuclear interactions.

According to the invention, the transparency of the intermediate electrodes, i.e. the perforated surface area proportion, is between 30 and 40% and is e.g. close to 32%. This transparency has been experimentally determined in such a way as to optimize the ionization current, as well as the slope of the current-voltage characteristic.

Figure 2:
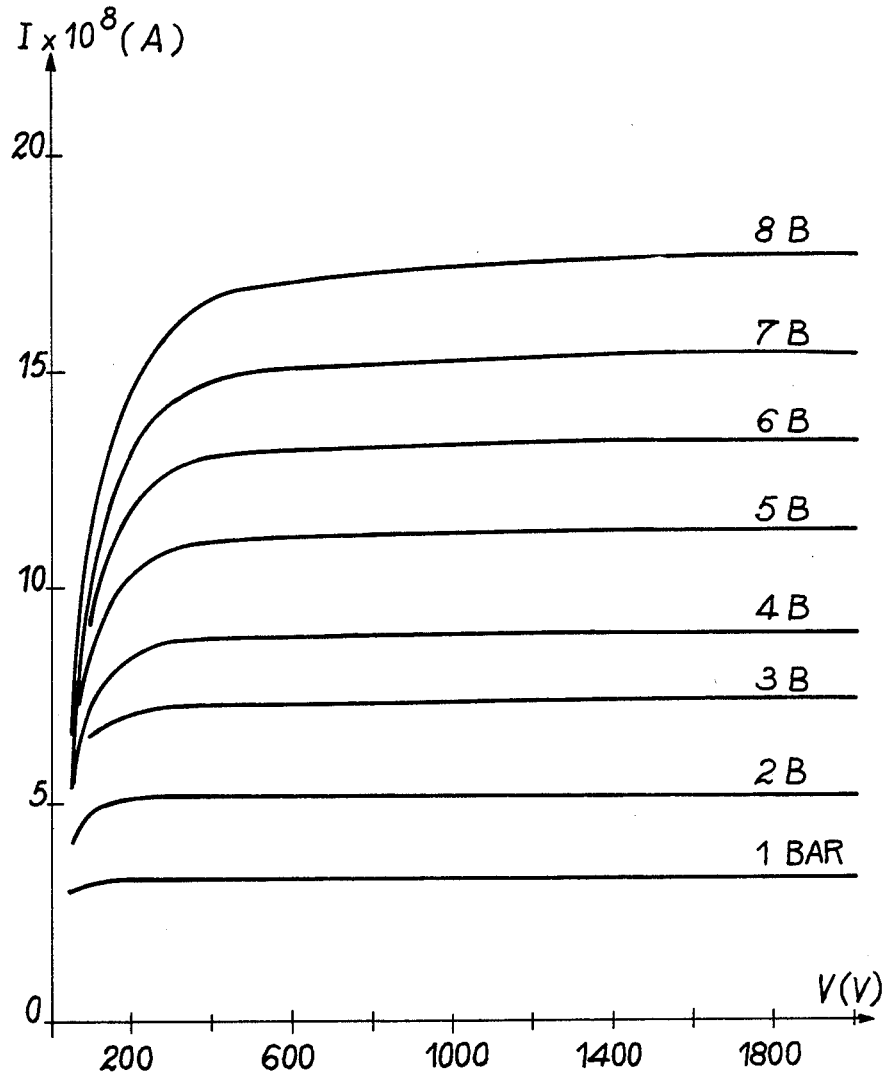
FIG. 2 curves giving the intensity of the ionization current I in amperes, as a function of the polarization voltage V of the electrodes in volts, these curves being given for different ionizable gas pressures and for a transparency of the perforated electrodes of 39%.

For different pressures of the ionizable gas, FIG. 2 shows the intensity of the ionization current I in amperes, as a function of the polarization voltage V applied to the electrodes in volts. For these measurements, the ionization chamber was filled with a gas containing 99% xenon and 1% nitrogen, using 4 electrodes and with a transparency of the intermediate electrodes of 39%.

It can be seen that a plateau, i.e. a zero slope region, is obtained on the current-voltage curves as from a polarization voltage of 450 V. These curves consequently make it possible to determine the polarization voltage to be applied in order to obtain a zero slope for a given transparency. As has been stated hereinbefore, the ionization current is dependent on the nature of the ionizable gas, as well as its pressure.

Investigations of the nature of the gas under normal pressure and temperature conditions have revealed that the following ionizable gases can be used in the ionization chamber, nitrogen, oxygen, air, argon or xenon. Xenon has the lowest electronic attachment coefficient and the ionization current value obtained with it is the highest. According to the invention, ionizable gas contains 98 to 99% of xenon. The gas can e.g. be formed by 98% by weight xenon and 2% by weight nitrogen, when it is wished to detect gamma photons having an energy close to 6 MeV, like those emitted by nitrogen 16 induced in the water of a pressurized water reactor vessel.

Moreover, it can be gathered from the curves of FIG. 2 that the higher the gas pressure, the higher the ionization current, so that it is advantageous to use a high pressure. Moreover, to take account of the lowest polarization voltage which can be used (450 V, the pressure of the gas is preferably chosen between 8.8 and 9.2 bars absolute.

During the detection of gamma photons having an energy of 6 MeV, use is e.g. made of a gas based on xenon having a pressure close to 9 bars.

In order to ensure a good collection of the ions formed in the ionization chamber, and in order to optimize the pass band, the clearances between the different electrodes are chosen so as to obtain a uniform electrical field throughout the enclosure. Thus, a simple calculation is able to show that the electrical field prevailing in a cylindrical zone between two cylindrical electrodes having a given potential difference, decreases on moving towards the outer electrode. By using five correctly spaced electrodes, it is possible to obtain a uniform electrical field having an intensity of 2000 V/cm for a polarization voltage of 1100 V. It should be noted that for this polarization voltage value, the current-voltage curves of FIG. 2 have a zero slope.

As has been stated hereinbefore, the essential part of the nuclear interactions, during the detection of gamma radiation with a high energy level (above 1 MeV) is produced in the walls of the enclosure and in the electrodes. In order to optimize the number of interactions and consequently the ionization current, the thickness of the enclosure wall and the material forming this wall and the electrodes must be chosen as a function of the energy of the gamma radiation to be measured.

During the detection of gamma photons with an energy level close to 6 MeV, use is preferably made of a stainless steel enclosure 2 having a thickness between 3 and 4 mm and e.g. close to 3.5 mm. This thickness, determined in such a way as to obtain a large number of nuclear interactions, is obviously also determined to withstand the high pressure of the gas filling the enclosure. In addition, the electrodes can also be made from stainless steel. The intermediate electrodes can be made in the form of perforated stainless steel sheets, which are rolled and welded together. It should be noted that the intermediate electrodes formed from perforated steel sheets have a mechanical strength which is greater than that of the electrode made in the form of a grid and as used in certain prior art ionization chambers. This makes it possible to contribute to the robustness of the chamber according to the invention and also to its service life.

Figure 3:
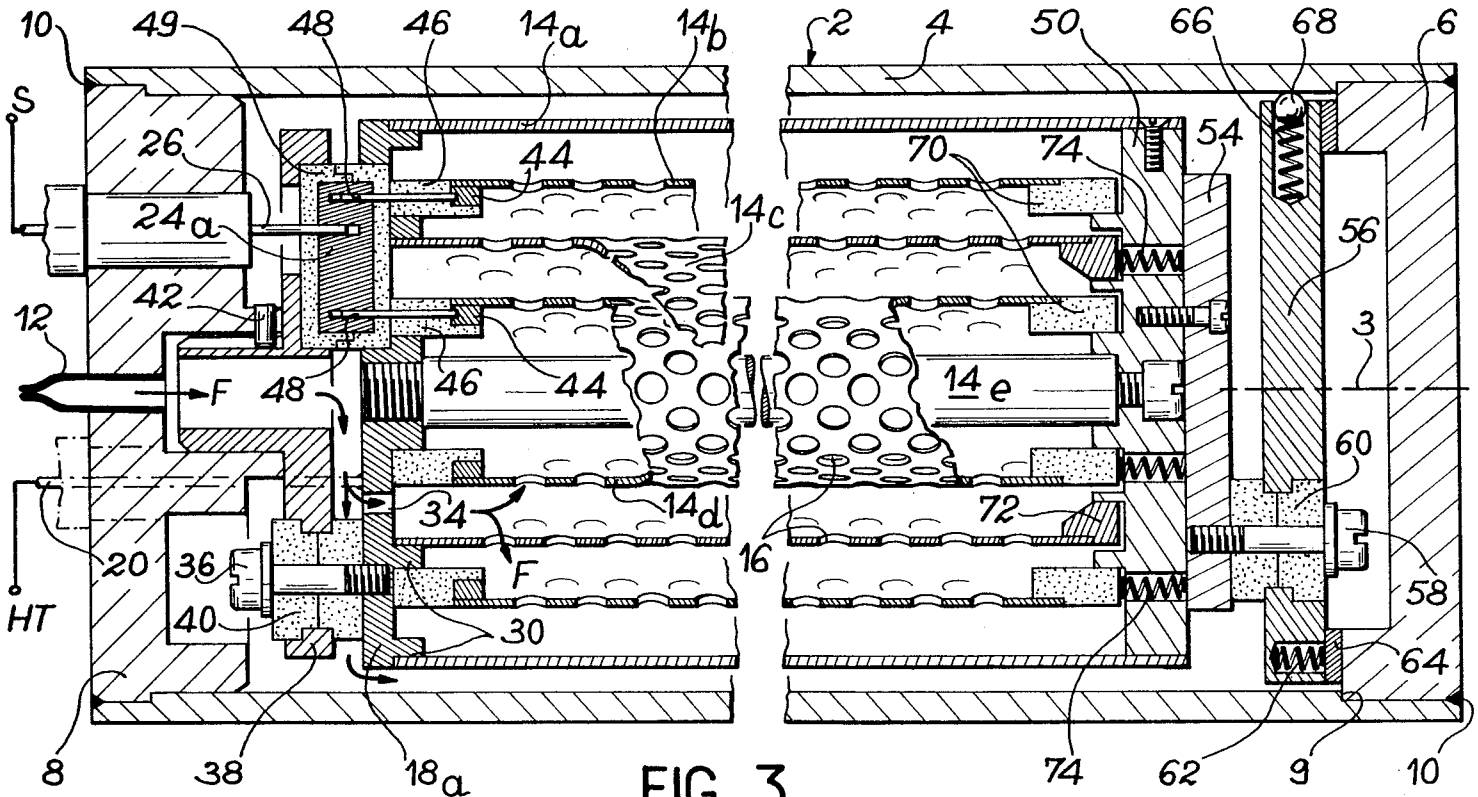
FIG. 3 a longitudinal sectional view of an embodiment of the ionisation chamber according to the invention.

FIG. 3 shows an embodiment of an ionization chamber according to the invention. This chamber comprises, as in the diagram of FIG. 1, a cylindrical enclosure 2 containing an ionizable gas, formed by a ferrule 4 and two flanges 6 and 8 welded to the ferrule at its ends, an exhaust tube 12 for filling the gas and five electrodes 14*a*, 14*b*, 14*c*, 14*d*, 14*e*, respectively corresponding to the outer electrode, the three intermediate perforated electrodes and the central electrode.

As shown in FIG. 3, the ends of electrodes 14*a*, 14*c* and 14*e* are in the vicinity of flange 8 and supported by a cylindrical conducting plate 18*a*, corresponding to part 18 in FIG. 1, and connected to the high voltage supply by means of a plug pin 20. The ends of the electrodes 14*a*, 14*c* are fitted into plate 18*a* level with the shoulder 30 and the end of electrode 14*e* is screwed into plate 18*a*. Plate 18*a* has an opening 34 to permit the passage of the gas into the enclosure (arrow F), whereby it is fixed by means of screws such as 36 to a holding plate 38. Screws 36 are insulated by means of an insulating sleeve 40, which is relatively insensitive to temperature variations, which obviates any electrical contact between plates 18*a* and 38. Holding plate 38 is fixed to flange 8 by means of a key system 42, which prevents the assembly from rotating and ensures the satisfactory positioning of the connections at the high voltage supply and at outlet S.

In the same way the ends of electrodes 14*b* and 14*d* are positioned in the vicinity of flange 8 and are joined to metal rings 44, fitted on to insulating rings 46, which are themselves fitted into plate 18*a*. These insulating rings 46 prevent any electrical contact between electrodes 14*b*, 14*d* and electrodes 14*a*, 14*c*, 14*e*. By means of plug pins 48 traversing the insulating rings 46, the metal rings 44 are connected to a metal piece 24*a*, corresponding to part 24 in FIG. 1. This piece 24*a*, which is mounted in an insulating block 49 fitted into holding plate 38 and plate 18*a*, is connected by means of a plug pin 26 to the outlet S. Block 49 prevents any electrical contact between ring 24*a* and plates 18*a* and 38 and consequently between electrodes 14*b*, 14*d* and electrodes 14*a*, 14*c*, 14*e*.

The ends of electrodes 14*a*, 14*c* are located in the vicinity of flange 6 and are fixed by any known means to a flange 50, via a plate 54, on a cylindrical part 56 in contact with flange 6. Plate 54 is joined to part 56 by screws 58, which are insulated from part 56 by insulating blocks 60. Springs 62, which bear on flange 6 by washer 64, compress part 56 and consequently flange 50 along axis 3 of enclosure 2. In the same way, springs 66 bearing on the inner surface of the ferrule 4 of the enclosure radially compress part 56 and consequently flange 50 via a ball 68.

The ends of the perforated electrodes 14*b*, 14*d* are located in the vicinity of flange 6 and are fitted into insulating rings 70, fitted into flange 50. In the same way, the end of perforated electrode 14*c* on the side of flange 6 is fitted into a metal ring 72 mounted on flange 50. Insulating rings 70 and metal ring 72 are axially compressed by springs 74, which bear on plate 54.

The use of springs 62 and 74 on the one hand and springs 66 on the other make it possible to maintain the axial and radial positioning of the ends of the electrodes located on the side of flange 6, so that it is ensured that the ionization chamber has a good thermal behaviour (compensation of expansions) and a good vibration resistance (vibrations of the medium in which the ionization chamber is placed).

Moreover, the good thermal behaviour of the chamber is ensured by using as the insulating material, a material which is relatively insensitive to temperature variations, such as steatite.

A description will now be given of an embodiment, and of the features of the ionization chamber according to the invention. The ionization chamber is constituted by an enclosure and five electrodes made from stainless steel and insulated by steatite. The enclosure has an internal diameter of 63 mm, a thickness of 3.5 mm and a length of 300 mm.

The outer electrode 14*a* is formed by a solid tube with an internal diameter of 57 mm and a thickness of 1 mm. The three intermediate electrodes 14*b*, 14*c*, 14*d* formed from perforated steel sheets, which are rolled and welded together, have a thickness of 0.4 mm and respective internal diameters of 46, 34 and 22 mm. They have a transparency of 32%.

The central electrode 14*e* is formed by a solid cylinder with a diameter of 8 mm. The useful detection volume of the chamber is 474 $cm^3$ for a total volume of 592 $cm^3$.

The filling gas contains 98% by weight xenon and 2% by weight nitrogen. The absolute pressure of the gas is 9 bars.

The average voltage is 1100 V and the maximum voltage 2000 V.

The electrical field between the electrodes, starting from the inner electrode for a polarization voltage of 1000 V is 2471, 2088, 1945 and 2210 V/cm, so that it is approximately uniform.

The theoretical sensitivity, characterized by the intensity of the current supplied for a gamma photon flux is $3.2 \cdot 10^{-9}$ A/rad/h for a gamma photon flux of 6 MeV, corresponding to a dose rate of 100 rad/h. The pass band is 0 to 140 Hz.

The characteristics of the aforementioned ionization chamber are highly suitable for the detection of gamma photons having an energy of 6 MeV, emitted by nitrogen 16, obtained by neutron activation of oxygen 16 contained in the water of the primary circuit of a pressurized water reactor.

What is claimed is:

1. An ionization chamber making it possible to measure high energy gamma radiation, wherein it comprises a tight cylindrical enclosure containing an ionizable gas, and several coaxial cylindrical electrodes, which are insulated from one another, and are positioned within the enclosure and are raised to different potentials, so as to produce an electrical field in the enclosure, whereby the innermost electrode is formed by a solid cylinder, the outermost electrode is formed by a solid tube and the intermediate electrodes are formed by a perforated tube.

2. An ionization chamber according to claim 1, wherein the perforated electrode has a transparency between 30 and 40%.

3. An ionization chamber according to claim 1, wherein the different electrodes have clearances between them such that the electrical field prevailing in the enclosure is substantially uniform throughout the latter.

4. An ionization chamber according to claim 1, wherein there are five electrodes.

5. An ionization chamber according to claim 1, wherein the ionizable gas contains 98 to 99% by weight of xenon.

6. An ionization chamber according to claim 1, wherein the pressure of gas is between 8.8 and 9.2 bars absolute.

7. An ionization chamber according to claim 1, wherein one of the ends of the electrodes is fixed, whilst the other end is maintained in position by first elastic means permitting an axial displacement and by second elastic means permitting a radial displacement.

8. An ionization chamber according to claim 7, wherein it comprises third elastic means, which act axially and solely on the other end of the intermediate electrodes.

9. An ionization chamber according to claim 1, wherein the intermediate electrodes are in each case formed by perforated metal sheets, which are rolled and welded together.

10. An ionization chamber according to claim 1, making it possible to measure gamma radiation with an energy level of approximately 6 MeV, wherein the enclosure and electrodes are made from stainless steel.

11. An ionization chamber according to claim 1, making it possible to measure gamma radiation having an energy level of approximately 6 MeV wherein the enclosure has a thickness between 3 and 4 mm.

* * * * *